US008887832B2

(12) United States Patent
Trinh et al.

(10) Patent No.: US 8,887,832 B2
(45) Date of Patent: Nov. 18, 2014

(54) APPARATUS AND METHODS FOR CORROSION PROTECTION OF DOWNHOLE TOOLS

(75) Inventors: Tu Tien Trinh, Houston, TX (US); Eric Sullivan, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 769 days.

(21) Appl. No.: 13/157,979

(22) Filed: Jun. 10, 2011

(65) Prior Publication Data

US 2011/0315444 A1 Dec. 29, 2011

Related U.S. Application Data

(60) Provisional application No. 61/358,572, filed on Jun. 25, 2010.

(51) Int. Cl.

| | |
|---|---|
| ***E21B 47/18*** | (2012.01) |
| ***E21B 10/00*** | (2006.01) |
| ***E21B 41/02*** | (2006.01) |
| ***E21B 10/08*** | (2006.01) |
| ***E21B 17/00*** | (2006.01) |

(52) U.S. Cl.

CPC ..... *E21B 41/02* (2013.01); *E21B 10/00* (2013.01); *E21B 10/08* (2013.01); *E21B 17/003* (2013.01); *Y10S 166/902* (2013.01)

USPC ..... 175/40; 175/327; 166/902

(58) Field of Classification Search

USPC ..... 175/40, 57, 327; 166/65.1, 902; 204/196.02, 196.06

See application file for complete search history.

(56) References Cited

U.S. PATENT DOCUMENTS

| | | | | | |
|---|---|---|---|---|---|
| 3,442,779 | A | * | 5/1969 | Hoey | 205/725 |
| 3,734,181 | A | * | 5/1973 | Shaffer | 166/65.1 |
| 3,818,996 | A | * | 6/1974 | McCaleb | 175/57 |
| RE29,151 | E | * | 3/1977 | McCaleb | 175/57 |
| 4,170,532 | A | * | 10/1979 | Tatum | 204/196.3 |
| 4,437,957 | A | * | 3/1984 | Freeman | 205/727 |
| 4,452,539 | A | | 6/1984 | Evans et al. | |
| 4,496,013 | A | | 1/1985 | Serpa | |
| 4,526,667 | A | * | 7/1985 | Parkhurst et al. | 204/196.06 |
| 4,624,329 | A | | 11/1986 | Evans et al. | |
| 5,012,868 | A | * | 5/1991 | Bridges | 166/248 |
| 5,330,016 | A | * | 7/1994 | Paske et al. | 175/320 |
| 5,509,490 | A | * | 4/1996 | Paske et al. | 175/57 |

(Continued)

OTHER PUBLICATIONS

International Search Report and Written Opinion dated Dec. 19, 2011 for International Application No. PCT/US2011/040267.

(Continued)

*Primary Examiner* — Kenneth L Thompson
*Assistant Examiner* — Michael Wills, III
(74) *Attorney, Agent, or Firm* — Cantor Colburn LLP

(57) ABSTRACT

In one aspect, an apparatus for use in a wellbore is provided that in one embodiment includes a drill bit having a bit body that is susceptible to corrosion when the drill bit is utilized in wellbore, an anode placed at a selected location on the bit body, a cathode associated with the bit body and a power source configured to provide electrical power to the anode to complete an electrical circuit between the anode and the bit body, wherein the supply of the electrical power to the anode arrests corrosion of the bit body when the drill bit is in the wellbore.

10 Claims, 5 Drawing Sheets

(56) References Cited

U.S. PATENT DOCUMENTS

| | | | | |
|---|---|---|---|---|
| 5,547,020 | A * | 8/1996 | Sable et al. | 166/65.1 |
| 5,739,424 | A | 4/1998 | Beavers | |
| 7,487,840 | B2 * | 2/2009 | Gammage et al. | 166/380 |
| 8,154,296 | B2 * | 4/2012 | Guo et al. | 324/425 |
| 8,607,878 | B2 * | 12/2013 | Knox | 166/345 |
| 2012/0160664 | A1 * | 6/2012 | Ivory et al. | 204/192.38 |

OTHER PUBLICATIONS

Spraytime Magazine, published by the International Thermal Spray Association, "Protecting a Sports Pavilion Steel Structure," vol. 15, No. 2, Second Quarter 2008, pp. 1 and 6.

Section 4.6: Cathodic Protection, Chapter 4; http://www.anr.state.vt.us/dec/wastediv/ust/erp/chapter_4.6.pdf.

* cited by examiner

APPARATUS AND METHODS FOR CORROSION PROTECTION OF DOWNHOLE TOOLS

CROSS REFERENCES TO RELATED APPLICATIONS

This application claims priority from the U.S. Provisional Patent Application having the Ser. No. 61/358,572 filed Jun. 25, 2010.

BACKGROUND OF THE DISCLOSURE

1. Field of the Disclosure

This disclosure relates generally to a apparatus for use in a wellbore, including apparatus including devices for protecting downhole tools from corrosion.

2. Description of the Related Art

Oil wells (also referred to as "wellbores" or "boreholes") are drilled with a drill string that includes a tubular member having a drilling assembly (also referred to as the "bottomhole assembly" or "BHA") at an end of the tubular member. The BHA typically includes devices and sensors that provide information relating to a variety of parameters relating to (i) drilling operations ("drilling parameters"); (ii) behavior of the BHA ("BHA parameters"); and (iii) parameters relating to the formation surrounding the wellbore ("formation parameters"). A drill bit attached to the bottom end of the BHA is rotated by rotating the drill string and/or by a drilling motor (also referred to as a "mud motor") in the BHA to disintegrate the rock formation to drill the wellbore. The components of the downhole tools of the drill string may be subject to corrosion that can shorten the life of the tools. In particular, areas that incur significant stress during a drilling operation may crack or fracture. The cracked area of the downhole tool may create areas of different electrical potential that attract corrosion, especially in certain environments, such as formations and/or fluid with a high amount of salt content. Thus, an expected life cycle of downhole tools may be greatly reduced due to cracking and corrosion in certain environments. It is desirable to provide downhole tools and/or assemblies that have increased protection from corrosion as compared to at least some of the currently available downhole tools.

SUMMARY

The disclosure, in one aspect, provides an apparatus for use in a wellbore that in one embodiment may include a drill bit having a bit body that is susceptible to corrosion when the drill bit is utilized in wellbore, an anode placed at a selected location on the bit body, a cathode associated with the bit body and a power source configured to provide electrical power to the anode to complete an electrical circuit between the anode and the bit body, wherein the supply of the electrical power to the anode arrests corrosion of the bit body when the drill bit is in the wellbore.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

For detailed understanding of the present disclosure, references should be made to the following detailed description, taken in conjunction with the accompanying drawings, in which like elements have been given like numerals and wherein.

DESCRIPTION OF THE DISCLOSURE

Figure 1:
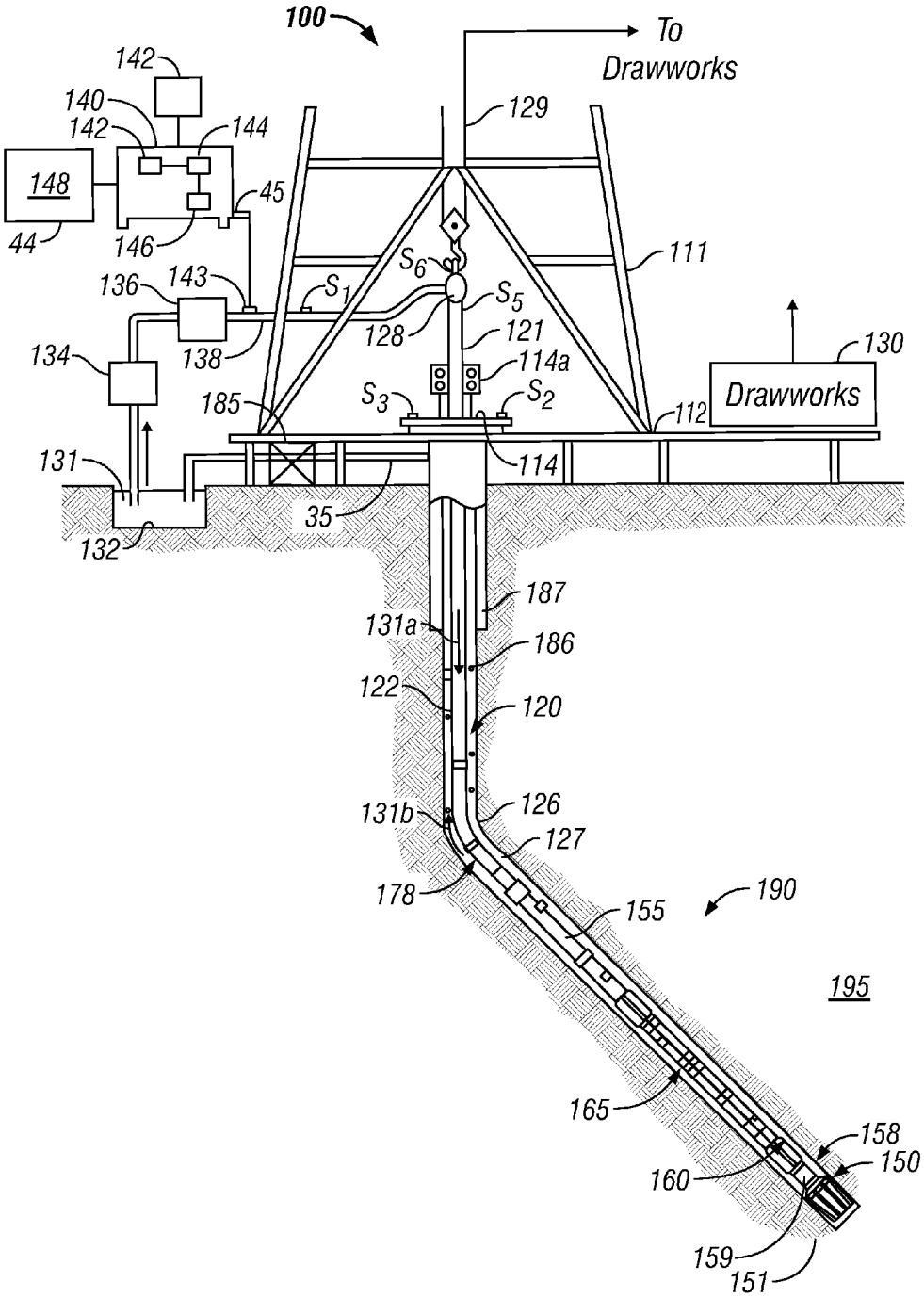
FIG. 1 is an elevation view of a drilling system including a downhole tool, according to an embodiment of the present disclosure.

FIG. 1 is a schematic diagram of an exemplary drilling system 100 that includes a drill string having a drilling assembly attached to its bottom end that includes a steering unit according to one embodiment of the disclosure. FIG. 1 shows a drill string 120 that includes a drilling assembly or bottomhole assembly ("BHA") 190 conveyed in a borehole 126. The drilling system 100 includes a conventional derrick 111 erected on a platform or floor 112 which supports a rotary table 114 that is rotated by a prime mover, such as an electric motor (not shown), at a desired rotational speed. A tubing (such as jointed drill pipe) 122, having the drilling assembly 190 attached at its bottom end extends from the surface to the bottom 151 of the borehole 126. A drill bit 150, attached to drilling assembly 190, disintegrates the geological formations when it is rotated to drill the borehole 126. The drill string 120 is coupled to a draw works 130 via a Kelly joint 121, swivel 128 and line 129 through a pulley. Draw works 130 is operated to control the weight on bit ("WOB"). The drill string 120 may be rotated by a top drive (not shown) instead of by the prime mover and the rotary table 114. The operations of the draw works 130 is known in the art and is thus not described in detail herein.

In an aspect, a suitable drilling fluid 131 (also referred to as "mud") from a source 132 thereof, such as a mud pit, is circulated under pressure through the drill string 120 by a mud pump 134. The drilling fluid 131 passes from the mud pump 134 into the drill string 120 via a desurger 136 and the fluid line 138. The drilling fluid 131*a* from the drilling tubular discharges at the borehole bottom 151 through openings in the drill bit 150. The returning drilling fluid 131*b* circulates uphole through the annular space 127 between the drill string 120 and the borehole 126 and returns to the mud pit 132 via a return line 135 and drill cutting screen 185 that removes the drill cuttings 186 from the returning drilling fluid 131*b*. A sensor $S_1$ in line 138 provides information about the fluid flow rate. A surface torque sensor $S_2$ and a sensor $S_3$ associated with the drill string 120 provide information about the torque and the rotational speed of the drill string 120. Rate of penetration of the drill string 120 may be determined from the sensor $S_5$, while the sensor $S_6$ may provide the hook load of the drill string 120.

In some applications, the drill bit 150 is rotated by only rotating the drill pipe 122. However, in other applications, a downhole motor 155 (mud motor) disposed in the drilling assembly 190 also rotates the drill bit 150. The rate of penetration ("ROP") for a given drill bit and BHA largely depends on the WOB or the thrust force on the drill bit 150 and its rotational speed.

A surface control unit or controller 140 receives signals from the downhole sensors and devices via a sensor 143 placed in the fluid line 138 and signals from sensors $S_1$-$S_6$ and other sensors used in the system 100 and processes such signals according to programmed instructions provided from a program to the surface control unit 140. The surface control unit 140 displays desired drilling parameters and other information on a display/monitor 142 that is utilized by an operator to control the drilling operations. The surface control unit 140 may be a computer-based unit that may include a processor 142 (such as a microprocessor), a storage device 144, such as a solid-state memory, tape or hard disc, and one or more computer programs 146 in the storage device 144 that are accessible to the processor 142 for executing instructions contained in such programs. The surface control unit 140 may further communicate with a remote control unit 148. The surface control unit 140 may process data relating to the drilling operations, data from the sensors and devices on the surface, data received from downhole and may control one or more operations of the downhole and surface devices.

The drilling assembly 190 also contain formation evaluation sensors or devices (also referred to as measurement-while-drilling ("MWD") or logging-while-drilling ("LWD") sensors) determining resistivity, density, porosity, permeability, acoustic properties, nuclear-magnetic resonance properties, corrosive properties of the fluids or formation downhole, salt or saline content, and other selected properties of the formation 195 surrounding the drilling assembly 190. Such sensors are generally known in the art and for convenience are generally denoted herein by numeral 165. The drilling assembly 190 may further include a variety of other sensors and devices 159 for determining one or more properties of the drilling assembly (such as vibration, bending moment, acceleration, oscillations, whirl, stick-slip, etc.) and drilling operating parameters, such as weight-on-bit, fluid flow rate, pressure, temperature, rate of penetration, azimuth, tool face, drill bit rotation, etc. For convenience, all such sensors are denoted by numeral 159.

Still referring to FIG. 1, the drilling system 100 further includes a protection device or apparatus 158 configured to protect a portion of or all of the BHA 190 and/or drill bit 150 downhole. In an aspect, the protection apparatus 158 may utilize adaptive impressed current cathodic protection (adaptive ICCP). The adaptive ICCP process or method utilizes an anode placed in or on one or more selected locations of the structure to be protected. In aspects, the protected structure is a downhole tool subjected to fatigue during drilling, which includes, but is not limited to, BHA 190, drill bit 150, a tubular, coring tool, a mud motor and/or a reamer. One or more anodes are electrically coupled to a power supply that is also located in the drill system 100. In another aspect, the protection apparatus 158 may include a sacrificial anode composed of a material that is less noble than the drill bit material. Certain exemplary embodiments of the protection device or apparatus 158 are described below in reference to FIGS. 2-5 below.

Figure 2:
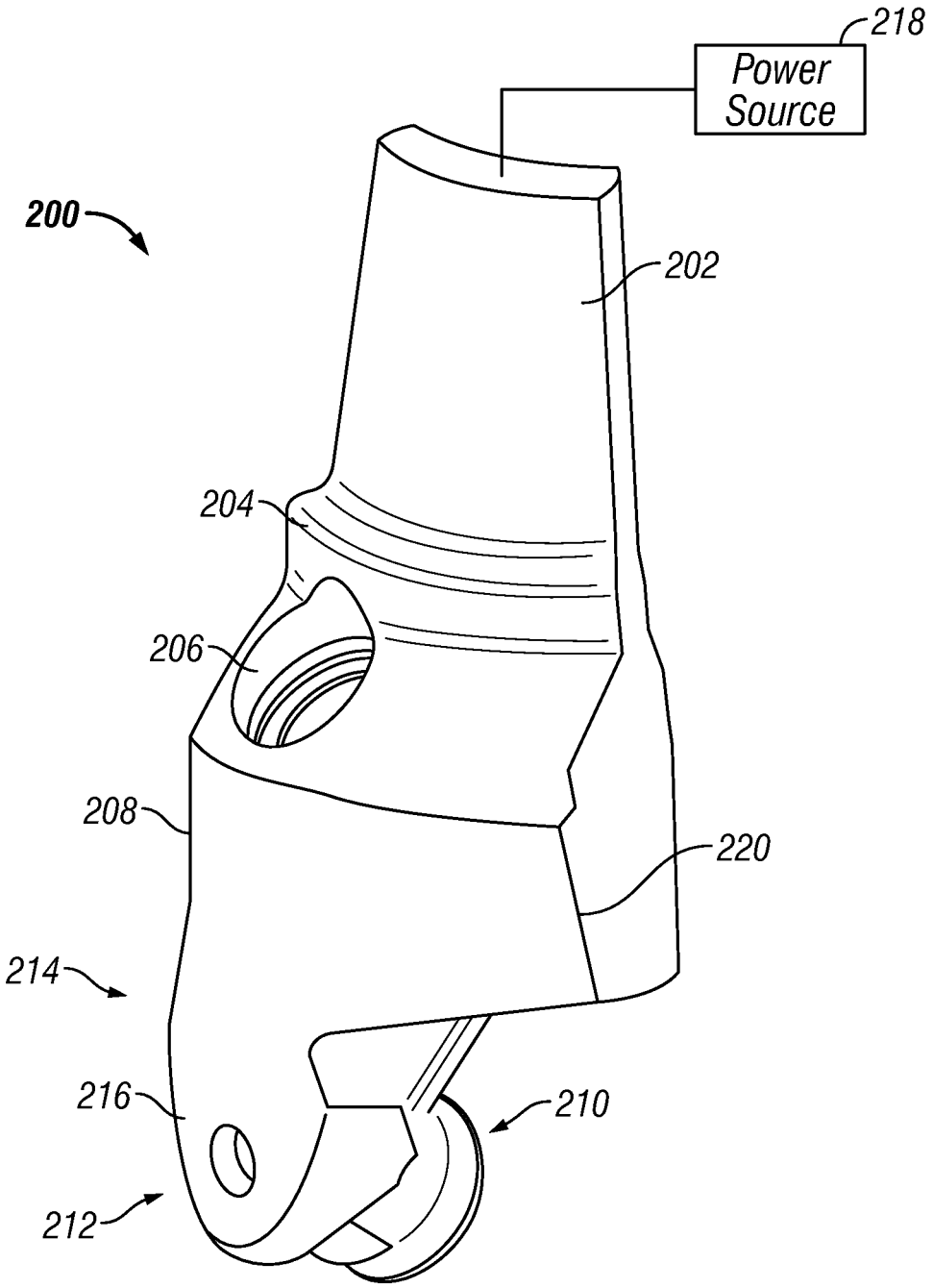
FIG. 2 is a perspective view of a portion of an exemplary drill bit with a protection apparatus, according to an embodiment of the present disclosure.

FIG. 2 is a perspective view of a portion of an exemplary drill bit 200 with a corrosion protection (or protection) apparatus 214, made according to one embodiment of the disclosure. As depicted, the drill bit portion 200 is one third of a roller cone bit, wherein three such sections make up a bit with a roller cone on each bit portion. The bit portion 200 includes a shank 202 and shoulder 204, where the shank includes a male coupling to a BHA, tubular or other drill string component, thereby affixing the bit to the end of the drill string. A reservoir 206 is located in body 208, where the reservoir contains grease or another lubricant to enable roller cone rotation. The roller cone (shown in FIG. 3) is configured to rotate on a bearing assembly 210 located on an inner portion of the bit 200. After placing the cone on the bearing assembly, a ball bearing is dropped into and a plug is placed on a plug hole 212, wherein the ball bearing and plug retain the cone on the bearing assembly 210. In an aspect, the protection apparatus 214 includes an anode 216 positioned near the plug hole 212. The anode 216 prevents or arrests corrosion near stressed regions of the bit, including the plug hole 212, to extend the life of the bit 200. A power source 218 supplies power to the anode 216 by a suitable electric coupling, such as a shielded copper wire. The power source 218 may be positioned in the bit 200 and/or in a structure uphole of the bit, such as the BHA or tubular. Although, the drill bit embodiment shown here in a roller cone drill bit, the concepts and aspects of the disclosure equally apply to any drill bit, including, but not limited to, PDC drill bits, tricone drill bits, and drill bits comprising steel.

In addition to the components used for adaptive impressed current cathodic protection, the protective system 214 also includes a sacrificial anode 220, which, in one embodiment, is a layer of a material that is less noble than the material of the bit 200. The less noble sacrificial anode material "sacrifices" itself by providing a chemical reaction with the sacrificial anode 220 instead of the steel drill bit 200 to be protected. The sacrificial anode 220 does not require power to arrest corrosion and may be used instead of or in combination with the power source 218 and anode 216 to arrest corrosion on the bit 200. The sacrificial anode 220 may be used instead of or in addition to the anode 216 and power source 218 used by the adaptive ICCP process to protect the bit 200 downhole.

In an embodiment, the protection apparatus 214 may include one or more anodes 216 positioned in selected areas of the bit which incur high amounts of stress during a drilling operation. In one aspect, the anode 216 is positioned near the plug hole 212 due to the stress that the region is subjected to during drilling. The protection apparatus 214 uses an adaptive ICCP process with the anode 216 and power source 218 to protect the bit 200. In aspects, the bit 200 is composed of a steel alloy, such AISI 4715 steel and the anode 216 is composed of a more noble material, such as ceramic, graphite or high silicon cast iron. A material that is more noble may be described as having a lower energy level or potential with respect to a reference material, such as the structure being protected.

While drilling a formation, the steel bit 200 may be exposed to corrosive chemicals downhole and in deep water applications. For example, formations having high salt content, where the salt is highly corrosive to steel alloys used in the tools. During drilling operations, the steel bit 200 is generally stressed and fatigued in certain areas, such as near the plug hole 212, creating regions that have a differential potential or energy than the non-stressed areas. The fatigued region may be referred to as an anodic region, where corrosive electrons from the surrounding earth (or salt water) are attracted to the anodic region. In the example, the soil (or fluid) acts as an electrolyte which allows the movement of the electrons to the stressed regions. To protect the steel bit 200, the power source 218 (such as a rectifier or battery or power generation unit in the drill bit) provides DC power to positively charge the anode 216, thereby causing the potential of the protected steel bit 200 to become more negative. The negative potential of the steel bit 200 causes the electrons to travel to the anode 216 instead of the anodic region, thereby arresting or inhibiting corrosion of the drill bit 200.

In an aspect, the adaptive ICCP process provides a selected and variable level of power to the anode 216 to cause a change in potential between the anode and the bit for arresting corrosion. For example, the drill bit 200 may encounter a low level of salt during drilling of a first section of a formation (for example, the first 4000 feet of wellbore depth) and a high level of salt for a second section of the formation (for example, from 4,000 to 10,000 feet depth). In such a scenario, the protection apparatus 214 may be configured to use an adaptive ICCP process to provide a low power to the anode 216 and corresponding reduced drill bit protection while drilling the first section (from 0 to 4,000 feet) and an increased power level and corresponding bit protection for drilling the second section (from 4,000 to 10,000 feet). Sensors (shown in FIG. 1) may be included in, and used by, the protection apparatus 214 to determine the levels of corrosion in the drilling environment, where the corrosion levels are used to determine corresponding power levels for the anode 214. For example, a sensor in the BHA and/or drill bit 200 may detect a parameter corresponding to salt, acidity and/or other corrosive properties downhole, thereby indicating the level of corrosion. Accordingly, the protection apparatus 214 provides instructions to the power source 218 to provide the corresponding level of power to anode 214, thereby adaptively protecting the bit 200. The protection apparatus 214 may include software, hardware, firmware, processors and memory downhole and/or at the surface to monitor and determine the corrosive properties of each region and the corresponding power levels for the anode 216 to protect the bit 200. Therefore, the anode 216 provides a positive charge that is greater than the anodic and fatigued region of the bit structure, thereby attracting the corrosive electrons which would typically be routed to the fatigued area. In the illustrated embodiment, the anode 216 provides a selected amount of a positive charge near the plug hole 212 and near a seal gland of the bearing assembly (shown in FIG. 5), which are subjected to a high level of stress during drilling.

The protection apparatus 214 conserves power by adjusting the power supplied to the anode 216 based on the environment's corrosive properties, thereby protecting the drill bit and its stressed regions. In an embodiment, the power source 218 includes a rectifier that is coupled to the mud motor to convert AC power from the motor to DC power for the anode. In another aspect, the power source 218 includes a battery and/or a power transmission line from the surface. As discussed above, the protective system 214 also includes a layer of sacrificial anode 220. The sacrificial anode 220 is composed of a material that is less noble than the steel alloy that composes the bit, such as zinc or magnesium. The less noble material of the anode layer 220 may also be described as having a negative electrochemical potential relative to or a higher energy level than the steel alloy of the bit 200. In aspects, the anode layer 220 may be applied to the surface of the bit 200 by any suitable means, such as brazing or other coating processes. In other aspects, the sacrificial anode 220 may be one or more members attached or coupled to the drill bit 200 structure to be protected. In an embodiment, the zinc sacrificial anode 220 loses electrons to the protected surface of the steel alloy bit 200, where dissolved oxygen is reduced, by gaining the electrons released by the zinc, to hydroxide anions. Thus, the reduction via zinc electrons produces oxidized zinc, instead of corrosion produced by oxiziding the protected steel alloy bit 200. As the anode 220 material is oxidized, it is "sacrificed," thereby causing the anode to deteriorate over time. In an aspect, one or more areas of the bit 200 may be coated with or coupled to a sacrificial anode 220 which protects selected high stress areas of the bit 200.

In aspects, the bit portion 200 may include a protection apparatus 214 with a combination of the adaptive ICCP components—the anode 216 and power source 218 and the sacrificial anode 220. In other embodiments, the protection apparatus 214 may include only adaptive ICCP components or only sacrificial anode 220. The material, number and type of components included in the protection apparatus may vary depending on downhole conditions, cost of components, expected life cycle and other application-specific parameters. The illustrated portion of drill bit 200 shows the protection apparatus for one-third of the bit, where the other bit portions include similar elements and components. Further, certain bit components, such as the cone and ball plug, have been removed to better show the protection apparatus 214 and bit 200. In addition, the protection apparatus 214 may be used on any type of downhole tool, including reamers, fixed cutter bits, BHAs, tubulars, mud motors or MWD apparatus bodies. In aspects, a cathode is associated with the bit body, wherein a cathode is attached to the body and/or the bit body itself acts as a cathode with respect to the anode and other components of the downhole tool.

Figure 3:
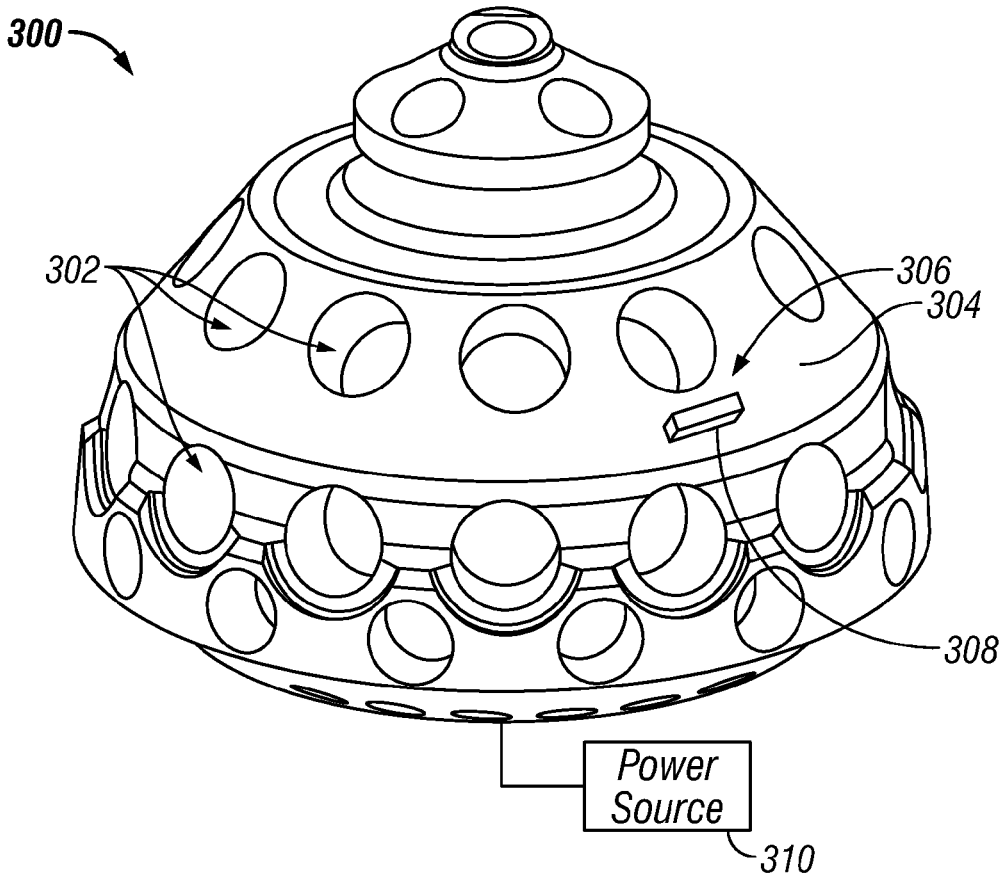
FIG. 3 is a perspective view of a cone of the drill bit with a protection apparatus to be coupled to the drill bit shown in FIG. 2, according to an embodiment of the present disclosure.

FIG. 3 is a perspective view of an embodiment of a roller cone 300 with a protection apparatus 306 to be coupled to a drill bit, such as the drill bit 200 shown in FIG. 2. The cone 300 includes cavities 302 for receiving cutting structures or cutters that are used to disintegrate the formation to create the wellbore. In aspects, the cavities 302 are spaced about the body 304 of the cone 300. The protection apparatus 306 may include powered anodes 308, power supply 310 and/or a layer of sacrificial anode to protect the cone structure, in a manner as discussed above with respect to the bit of FIG. 2. In one aspect, the areas near cavities 302 experience a significant amount of stress, and, therefore, are protected by a sacrificial anode coating or member near the cavities 302. Further, the adaptive ICCP process may power an anode located near one or more cavities 302 to protect the stressed area from corrosion. In an embodiment, one or more powered anodes 308 may be placed on the cone 300 of the bit and electrically coupled to the power source 310 located in the bit or BHA, where the power level supplied to the anode(s) is adjusted according to the sensed corrosive properties of the drilling environment. In an aspect, the cone 300 may also have a sacrificial anode layer or structure near the stressed or fatigued cavity regions to further arrest corrosion of the cone.

Figure 4:
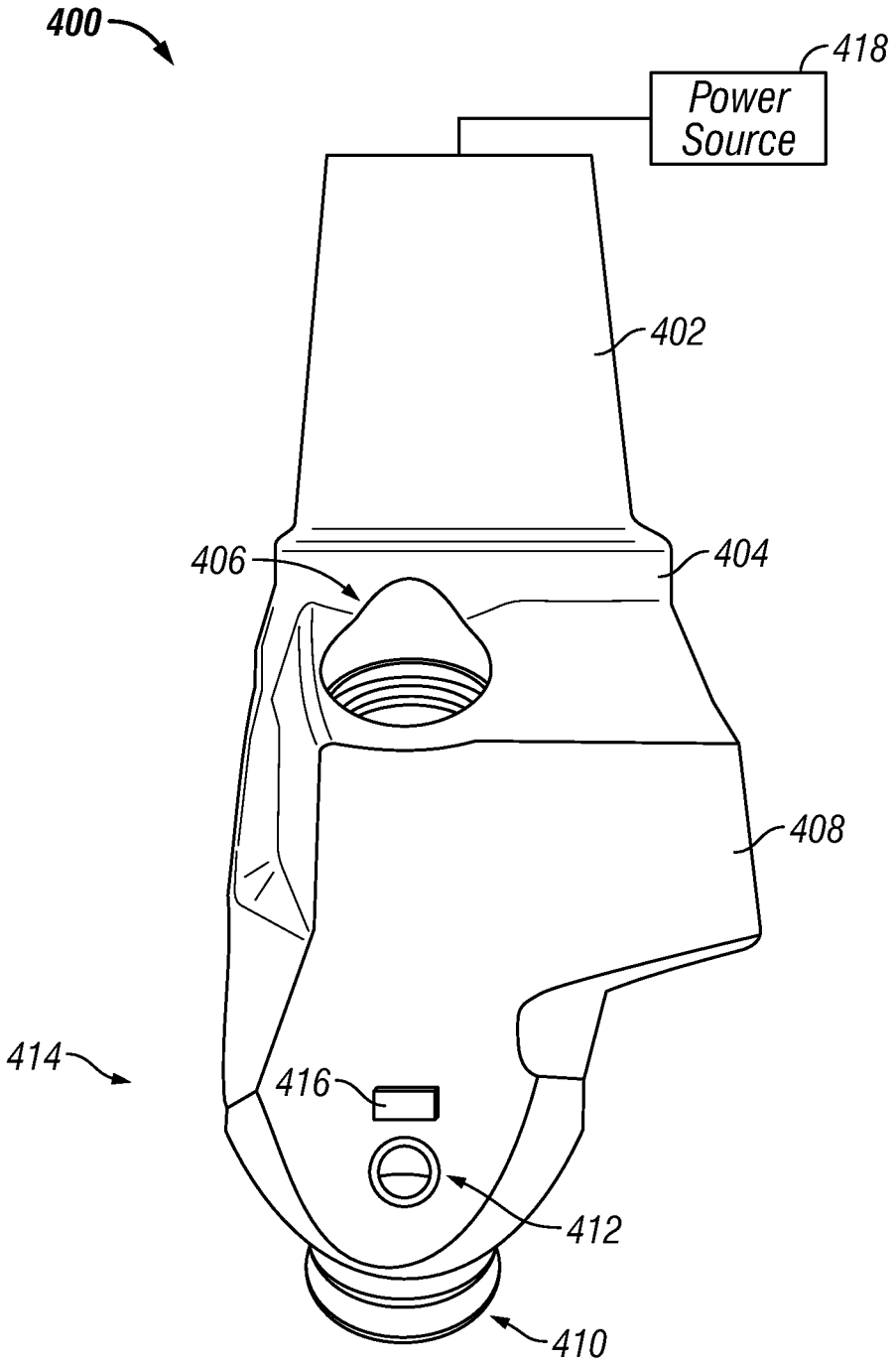
FIG. 4 is a side view of the drill bit with a protection apparatus shown in FIG. 2.

FIG. 4 is a side view of an embodiment of a drill bit 400 with a protection apparatus 414, as shown in FIG. 2. The drill bit 400 portion is a third of a roller cone drill bit that includes a shank 402, shoulder 404, and reservoir 406. The reservoir 406 is located in body 408, where the reservoir contains grease to facilitate movement of the roller cone. The roller cone is configured to rotate on the bearing assembly 410 located on an inner portion of the bit 400. A plug hole 412 is located on the outer portion of the bit, where a ball bearing and plug are placed to secure the cone after it is placed on the bearing assembly 410. The drill bit 400 further includes the protection apparatus 414, which uses an anode 416, power source 418 and a sacrificial anode to protect the drill bit 400 from corrosion. In aspects, the power source 418 may be located in the BHA and/or the drill string tubular, where an electrical coupling provides a selected amount of power from the power source 418 to the anode 416. The protection apparatus 414 includes a layer of sacrificial anode on the surface of the bit 400, as described above with respect to FIG. 2. The sacrificial anode, power source 418 and anode 416 may arrest corrosion near high stress and fatigue areas of the bit 400, such as near the plug hole 412. As discussed above, the power source 418 and anode 416 protect the bit 400 using adaptive ICCP. The adaptive ICCP process adjusts the power level supplied to the anode 416 based on the corrosive properties of the environment, which are sensed by corresponding sensors downhole.

Figure 5:
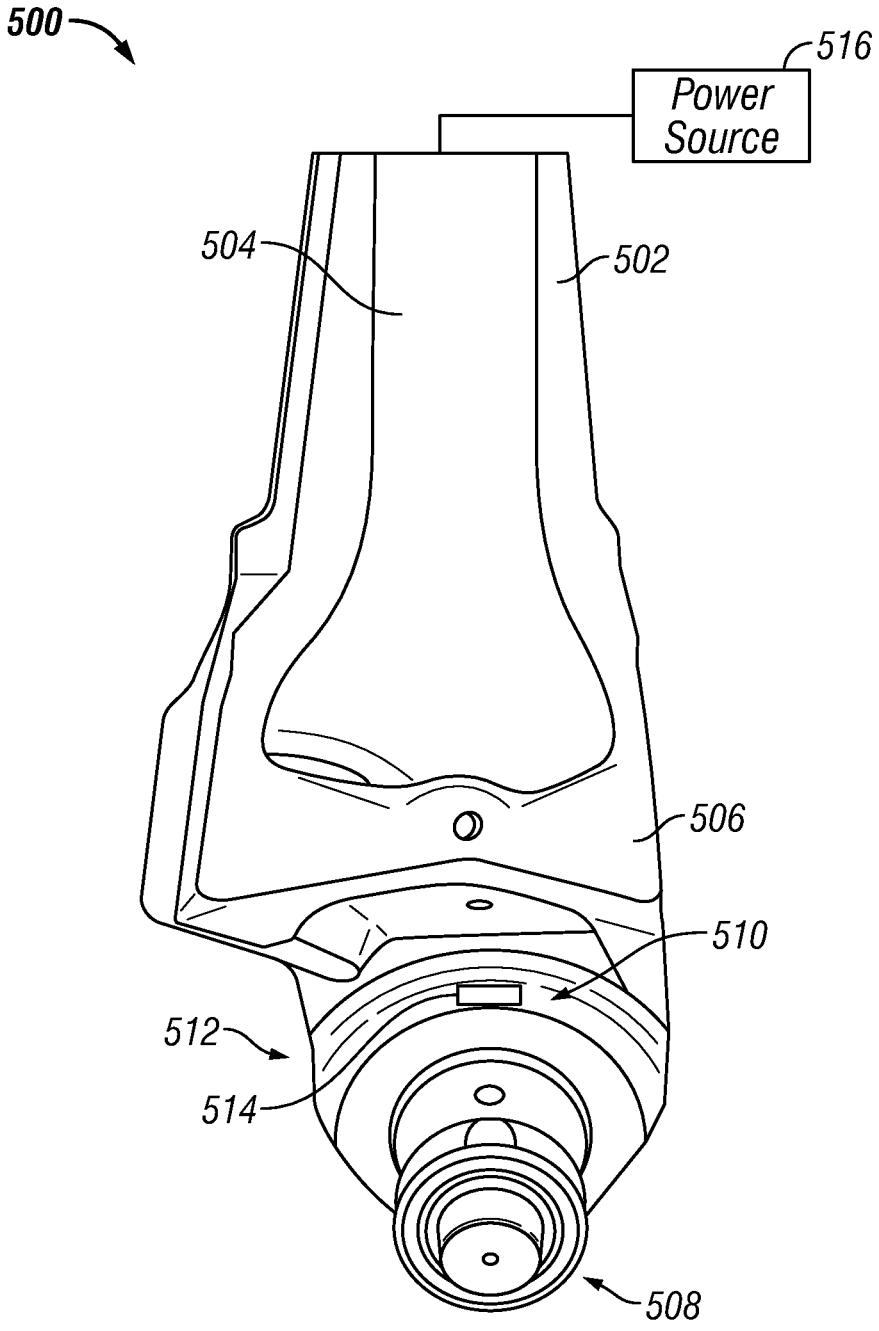
FIG. 5 is a back side view of the drill bit with a protection apparatus shown in FIG. 2.

FIG. 5 is a back side view of an embodiment of a drill bit 500 with a protection apparatus 512, as shown in FIG. 2. The drill bit 500 includes a shank 502, drilling fluid cavity 504, body 506 and bearing assembly 508. A seal gland area 510 is located near the bearing assembly 508. The seal gland seals an inner portion of the cone from the outer portion of the cone to prevent lubricants from leaking and external fluids from contaminating the lubricants. In an embodiment, the seal gland area 510 may experience increased fatigue and stress during drilling. Therefore, the protection apparatus 512 is located near seal gland area 510 to protect the area from corrosion during drilling. The protection apparatus 512 includes anode 514 and power source 516, where the anode 514 is powered at a selected level based on the detected corrosive properties of the environment, as described above. In addition, the protection apparatus 512 may also include a sacrificial anode layer or structure to further protect the drill bit 500 downhole.

Thus, in one aspect, the disclosure provides an apparatus for use in a wellbore that in one embodiment may include a drill bit having a bit body that is susceptible to corrosion when the drill bit is utilized in wellbore, an anode placed at a selected location on the bit body, a cathode associated with the bit body, and a power source configured to provide electrical power to the anode to complete an electrical circuit between the anode and the bit body, wherein the supply of the electrical power to the anode arrests corrosion of the bit body when the drill bit is in the wellbore. In another aspect, the apparatus may further include a sensor configured to provide a measurement relating to the corrosion of the drill bit when the drill bit is in the wellbore. A processor may be provided that is configured to control the supply of the electrical power to the anode in response to the measurement of the sensor. Any suitable power source may be utilized to supply power to the anode, including, but not limited to: a battery in the drill bit; a source outside the drill bit supplying power to the anode via an electrical conductor; a source that generates power using flow of a fluid during a drilling operation; and a power source that generates power using flow of a fluid through the drill bit during use of the drill bit in a wellbore.

In another aspect, a tool for use in a wellbore is provided that in one embodiment includes a tool body, an anode placed at a selected location on the tool body, a cathode associated with the bit body, and a power supply coupled to the anode for providing electrical power to the anode, wherein supply of the power to the anode arrests corrosion of the tool body when the tool is in the wellbore.

In yet another aspect, a drill bit is provided that in one embodiment includes a bit body made of a first material, and a second material attached to a selected region of the bit body, the second material having a negative electrochemical potential relative to the first material, wherein the second material on the selected region is configured to dissolve when the drill bit is in a wellbore to protect the bit body from corrosion.

In yet another aspect, a method for arresting corrosion of a downhole tool is provided, which method according to one embodiment may include: providing a drill bit having a bit body that is susceptible to corrosion when the drill bit is utilized in a wellbore, placing an anode at a selected location on the bit body, providing a cathode associated with the bit body, and supplying electrical power to the anode when the tool is in the wellbore to complete an electrical circuit between the anode and the cathode, thereby arresting corrosion of the bit body when the drill bit is in the wellbore.

In yet another aspect, another embodiment of a method for arresting corrosion of a drill bit may include: providing a drill bit having a bit body made of a first material; and attaching a second material at a selected region of the bit body, the second material having a negative electrochemical potential relative to the first material, wherein the second material on the selected region is configured to dissolves when the drill bit is in a wellbore to protect the bit body from corrosion.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure and the following claims.

The invention claimed is:

1. An apparatus for use in a wellbore, comprising:

a drill bit;

an anode placed at a selected location on drill bit;

a cathode associated with the drill bit;

a power source configured to provide electrical power to the anode to complete an electrical circuit between the anode and the cathode, wherein the supply of the electrical power to the anode arrests corrosion of the bit when the drill bit is in the wellbore; and a sensor configured to provide a measurement relating to the corrosion of the drill bit when the drill bit is in the wellbore, wherein the electrical power to the anode is adjusted according to the measurement relating to the corrosion of the drill bit.

2. The apparatus of claim 1 further comprising a controller configured to control the supply of the electrical power to the anode in response to the measurement of the sensor.

3. The apparatus of claim 1, wherein the power source is selected from a group consisting of: a battery in the drill bit; a source outside the drill bit supplying power to the anode via an electrical conductor; a source that generates power using flow of a fluid during a drilling operation; and a source that generates power using flow of a fluid flowing through the drill bit when the drill bit in a wellbore.

4. A method for providing a drill bit, comprising:

providing a bit body that is susceptible to corrosion when the drill bit is in a wellbore;

providing an anode at a selected location on the bit body;

providing a cathode associated with the bit body;

supplying electrical power to the anode when the tool is in the wellbore to complete an electrical circuit between the anode and the cathode, thereby arresting corrosion of the bit body when the drill bit is in the wellbore; and taking a measurement relating to the corrosion of the drill bit with a sensor when the drill bit is in the wellbore, wherein the electrical power to the anode is adjusted according to the measurement relating to the corrosion of the drill bit.

5. The method of claim 4 further comprising controlling the supply of the electrical power to the anode in response to the measurement of the sensor.

6. The method of claim 4, wherein the supplying the power comprises supplying power form a power source selected from a group consisting of: a battery in the drill bit; a source outside the drill bit supplying power to the anode via an electrical conductor; a source that generates power using flow of a fluid during a drilling operation; and a source that generates power using flow of a fluid flowing through the drill bit when the drill bit in a wellbore.

7. A drill bit, comprising;

an anode placed at a selected location on the drill bit;

a cathode associated with the drill bit;

a power source configured to provide electrical power to the anode to complete an electrical circuit between the anode and the cathode, wherein the supply of the electrical power to the anode arrests corrosion of the bit when the drill bit is in the wellbore; and a sensor configured to provide a measurement relating to the corrosion of the drill bit when the drill bit is in the wellbore, wherein the electrical power to the anode is adjusted according to the measurement relating to the corrosion of the drill bit.

8. The drill bit of claim 7 further comprising a processor configured to control the supply of the electrical power to the anode in response to the measurement of the sensor.

9. The drill bit of claim 7, wherein the power source is selected from a group consisting of: a battery in the drill bit; a source outside the drill bit supplying power to the anode via an electrical conductor; a source that generates power using flow of a fluid during a drilling operation; and a source that generates power using flow of a fluid flowing through the drill bit when the drill bit in a wellbore.

10. The drill bit of claim 7, wherein the drill bit is selected from a group consisting of: a roller cone drill bit; a PDC drill bit; and a drill bit comprising steel.

* * * * *